US006499859B2

(12) United States Patent
Petzl et al.

(10) Patent No.: US 6,499,859 B2
(45) Date of Patent: Dec. 31, 2002

(54) PORTABLE LIGHTING LAMP WITH LIGHT-EMITTING DIODES

(75) Inventors: Paul Petzl, Barraux (FR); Alain Maurice, Meylan (FR); Lionel Ferragut, Saint Martin d'Heres (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 09/861,665

(22) Filed: May 22, 2001

(65) Prior Publication Data

US 2002/0024806 A1 Feb. 28, 2002

(30) Foreign Application Priority Data

Jun. 5, 2000 (FR) ..... 00 07173

(51) Int. Cl.[7] ..... F21L 4/02

(52) U.S. Cl. ..... 362/184; 362/183; 362/190; 362/191; 362/235; 362/249; 362/800

(58) Field of Search ..... 362/184, 183, 362/190, 191, 235, 249, 800

(56) References Cited

U.S. PATENT DOCUMENTS 3,714,411 A * 1/1973 Waters et al. ..... 240/6.45
4,772,990 A 9/1988 Linehan et al.
5,446,345 A 8/1995 Halabi et al.
5,446,441 A 8/1995 Su

FOREIGN PATENT DOCUMENTS

DE 39 29 125 A1 3/1990
DE 39 16875 A1 12/1990
WO WO 98/06975 2/1998

* cited by examiner

*Primary Examiner*—Sandra O'Shea
*Assistant Examiner*—Marc Tsidulko
(74) *Attorney, Agent, or Firm*—Oliff & Berridge, PLC

(57) ABSTRACT

A portable lighting lamp comprises a housing containing a lighting module with light-emitting diodes, an electric power source by means of batteries, and a switch for control of lighting of the light-emitting diodes. The housing comprises an intermediate support made of insulating plastic material which is equipped with a securing device on the front wall for fitting of the lighting module, positioning means imbricated on the two opposite sides between contacts in electrical connection with the light-emitting diodes and the batteries, and recesses on the rear wall for housing the batteries between the contacts.

8 Claims, 9 Drawing Sheets

PORTABLE LIGHTING LAMP WITH LIGHT-EMITTING DIODES

BACKGROUND OF THE INVENTION

The invention relates to a portable lighting lamp comprising a housing containing a lighting module with light-emitting diodes LED, an electrical power source, notably by means of batteries, rechargeable or not, and a switch to control lighting of the light-emitting diodes LED.

STATE OF THE TECHNIQUE

Light-emitting diodes generally have a longer lifetime than that of filament bulbs and have a high electrical efficiency.

The documents DE 2,971,229, DE 3,916,875 and DE 3,929,125 describe lighting devices making use of light-emitting diodes. Assembly of these devices is complicated and requires a large amount of space.

OBJECT OF THE INVENTION

The object of the invention is to achieve a lighting lamp with light-emitting diodes having a structure making for quick assembly and compact dimensions.

The lighting lamp according to the invention is characterized in that the housing comprises an intermediate insulating support equipped with:

- a securing means on the front wall for fitting of the lighting module,
- positioning means imbricated on the two opposite sides between contacts in electrical connection with the light-emitting diodes and the power supply batteries,
- and recesses on the rear wall for housing the batteries between the contacts.

According to a preferred embodiment, the positioning means are arranged to enable the intermediate support to be clipped onto a dish-shaped base and onto a front enclosure so as to confine a first compartment housing the lighting module and a second compartment accommodating the batteries. The lighting module comprises an insulating base-part having a series of recesses for housing the light-emitting diodes, one of the sides of said base-part enabling parallel connection of the wires whereas the other side acts as support for the switch having a flexible contact blade operating in conjunction with a fixed conductor. The contact blade is actuated by a control button accessible in a groove of the enclosure. The control button is secured to a mobile slide urging the contact blade to the closed position or the open position of the switch.

According to one feature of the invention, a reflector is provided with circular holes for passage of the light-emitting diodes, said reflector being arranged in the first compartment between the lighting module and a glass pane of the front enclosure.

According to another feature of the invention, the intermediate support is joined to the base by hinges formed by a pair of flexible plastic tabs clipped onto studs of the base.

BRIEF DESCRIPTION OF THE DRAWINGS

Other advantages and features will become more clearly apparent from the following description of an embodiment of the invention, given as a non-restrictive example only and represented in the accompanying drawings in which.

DESCRIPTION OF A PREFERRED EMBODIMENT

Figure 1:
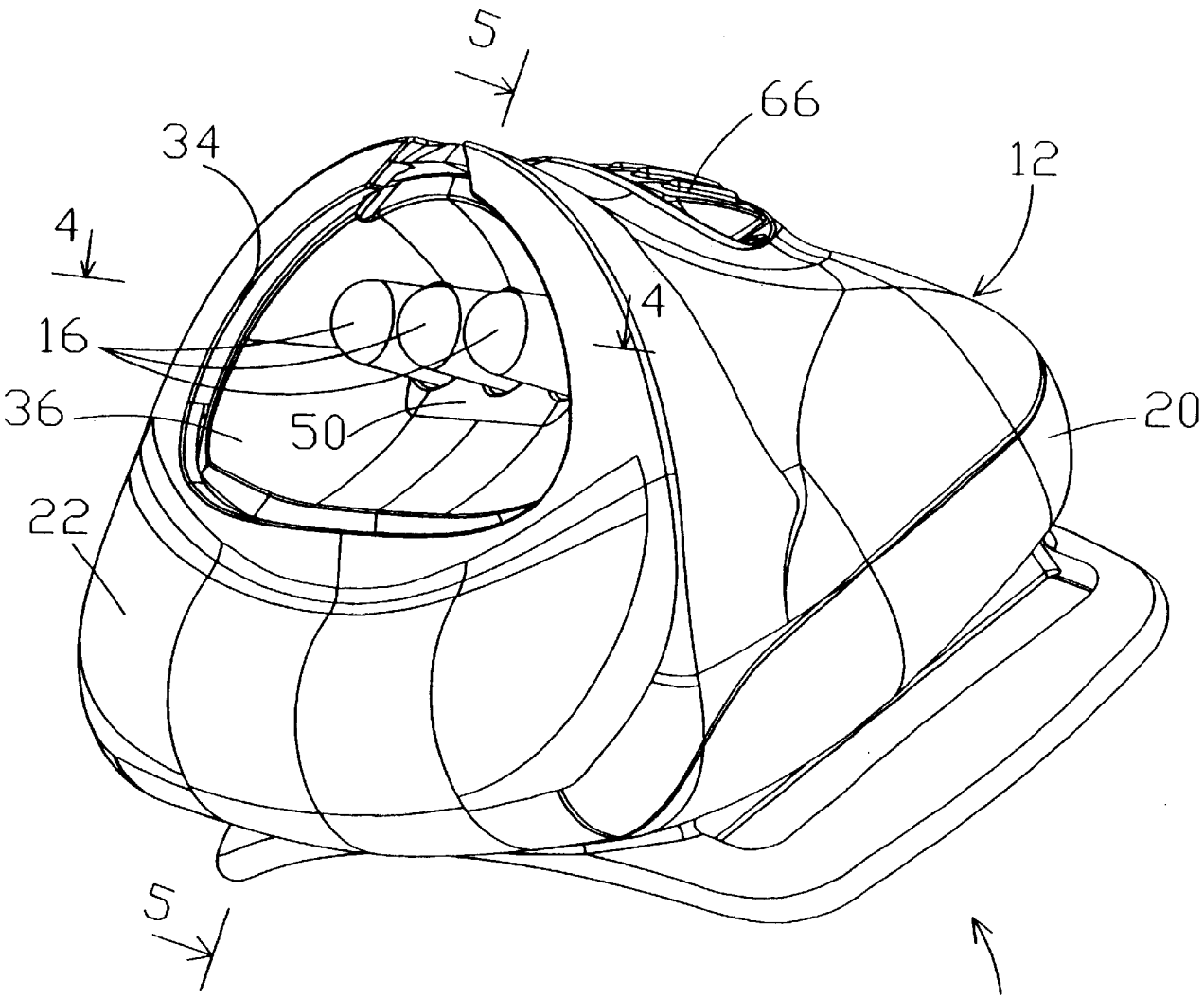
FIG. 1 is a perspective view of the lighting lamp according to the invention, the housing being shown in the assembled position.
Figure 2:
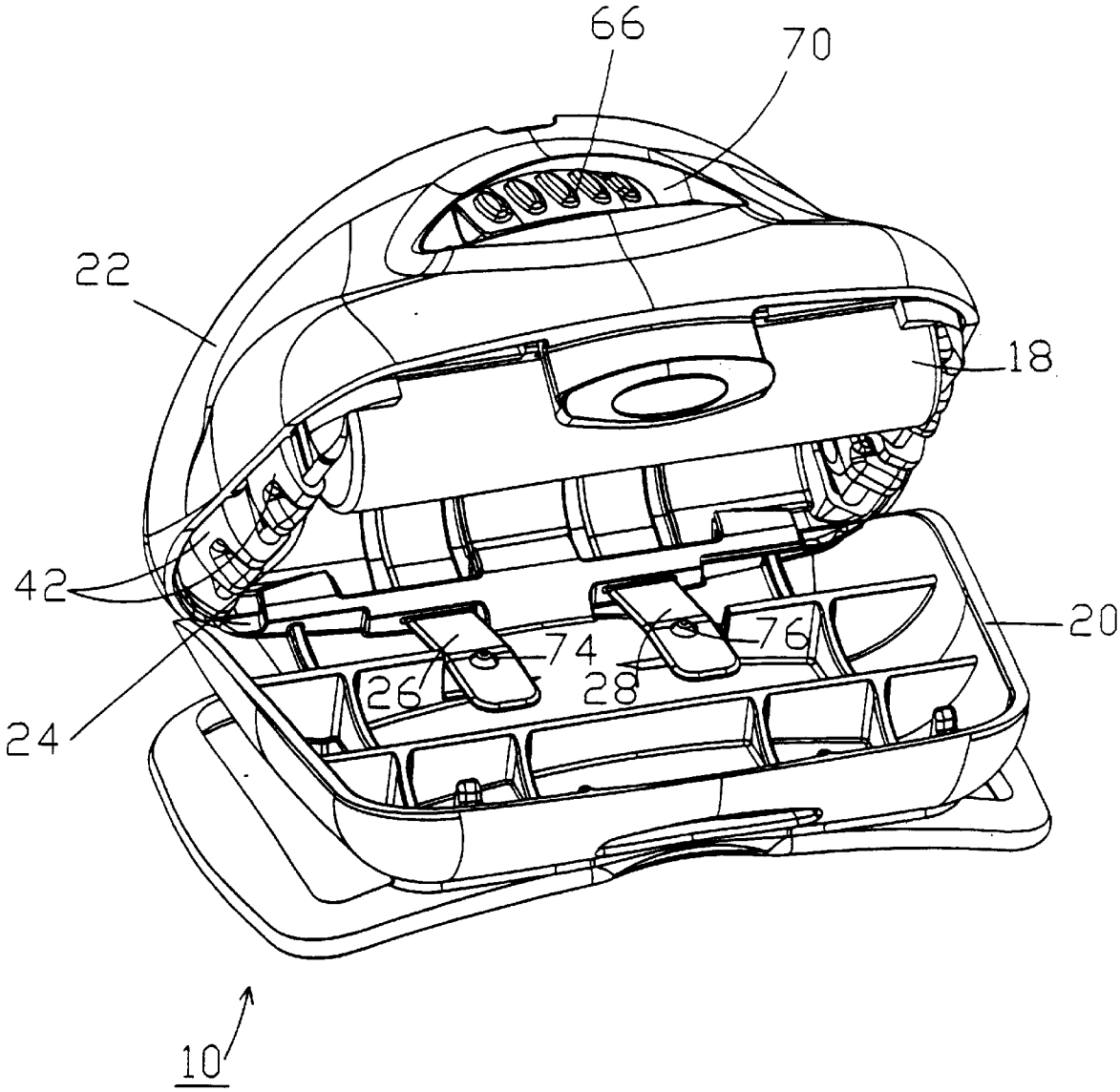
FIG. 2 represents a perspective view of the lamp when the base of the housing is open.
Figure 3:
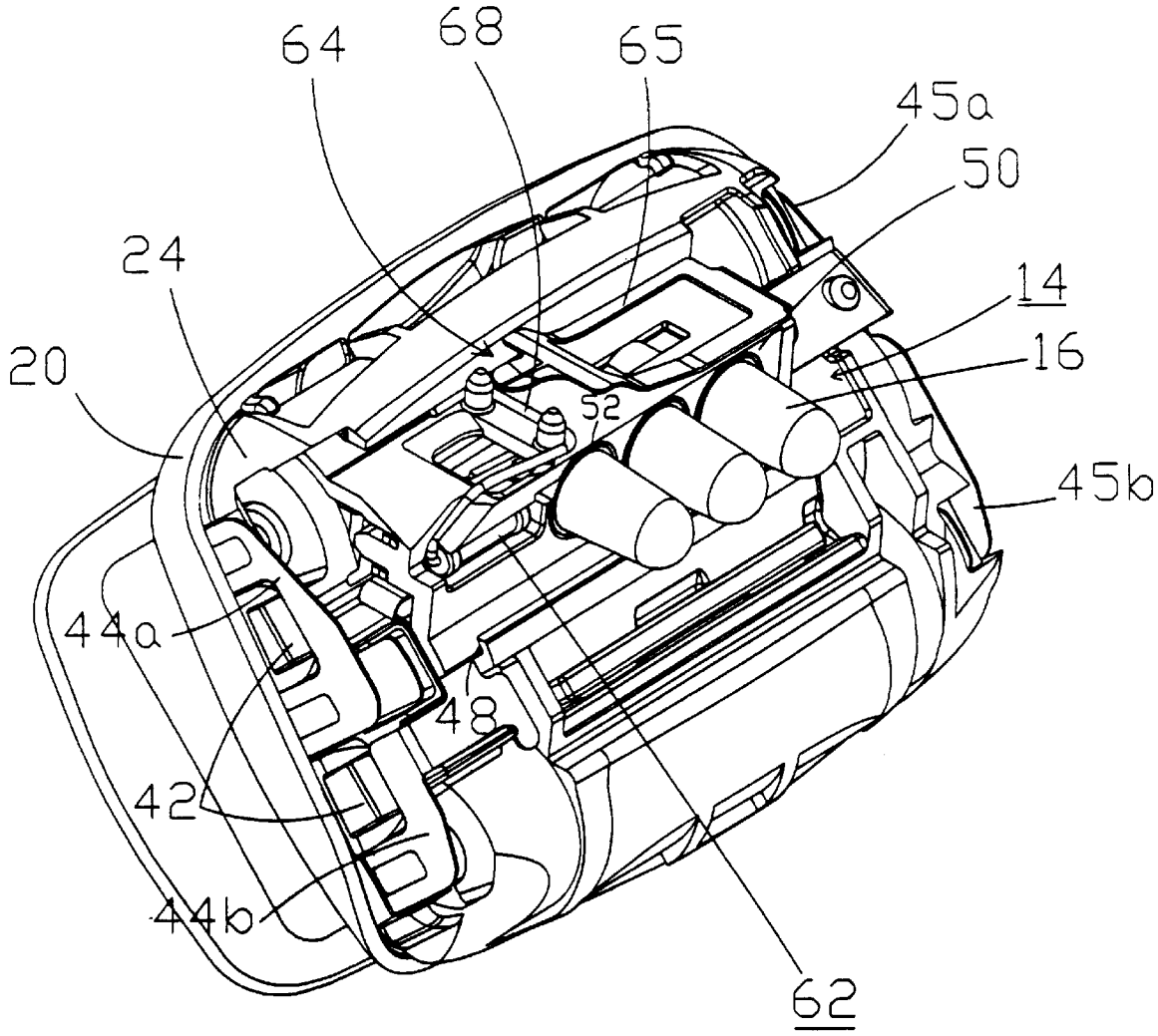
FIG. 3 shows a perspective view of the lighting module fitted on the intermediate support of the housing.

With reference to FIGS. 1 to 9, a portable electric lamp 10 comprises a housing 12 made of molded plastic material containing a lighting module 14 with light-emitting diodes LED 16, and a DC power source by means of batteries 18 or rechargeable batteries.

The housing 12 is formed by assembly of a dish-shaped base 20, a front enclosure 22, and an intermediate support 24, which is joined to the base 20 by a pair of hinges 26, 28 with flexible tabs.

Assembly of the three elements constituting the housing 12 is achieved by clipping, the intermediate support 24 subdividing the inside of the housing 12 into a first compartment 30 housing the lighting module 14 and a second compartment 32 accommodating the cylindrical batteries 18. The front enclosure 22 is provided with a front window 34 sealed by a transparent glass pane 36 letting the light beam emitted by the light-emitting diodes LED 16 pass. A reflector 38 is arranged in the first compartment 30 between the lighting module 14 and the glass pane 36 and is provided with circular holes 40 to enable the light-emitting diodes to pass.

The two opposite sides of the intermediate support 24 are each equipped with positioning means 42 imbricated between contacts 44*a*, 44*b*; 45*a*, 45*b*, the latter being electrically connected to the batteries 18 and the lighting module 14. The rear wall of the intermediate support 24 presents an alveolar structure designed to support the batteries 18, each recess 46 having the form of a cylindrical sector extending transversely between the contacts 44*a*, 44*b*; 45*a*, 45*b*. The front wall of the intermediate support 24 comprises a securing means 48 for fitting the lighting module 14. The securing means 48 can be formed by a straight slide or a clip.

The lighting module 14 comprises a base-part 50 made of insulating material, which is provided with a series of blind recesses 52 for housing the light-emitting diodes 16. Two holes are drilled in the bottom of each recess 52 and pass through the base-part 50 for the two wires 54, 56 of the corresponding light-emitting diode 16 to pass through. The three wires 54 of the same polarity are connected to a first connection point 58 which is at the potential of one of the poles of the DC power source. The other three wires 56 of opposite polarities are connected to a second common point 60 electrically connected to the other pole by means of a resistor 62 and a switch 64.

The switch 64 comprises a flexible contact blade 65 actuated by a control button 66 against a fixed conductor 68. The button 66 is accessible in a groove 70 of the enclosure 22 and drives a mobile slide 72 to move the contact blade 65 to the closed position (FIG. 8) or the open position (FIG. 9) of the switch 64. The fixed conductor 68 of the switch 64 is connected to the resistor 62 opposite the second common point 60.

The three light-emitting diodes 16 are aligned transversely on the base-part 50 of the lighting module 14, but the arrangement and number of light-emitting diodes 16 can naturally be modified.

Closing of the switch 64 causes power supply of the light-emitting diodes 16 in parallel by flow of a direct current the intensity of which depends on the value of the resistor 62. An electronic circuit can be used to adjust the lighting of the diodes.

Assembly of the portable lamp 10 according to the invention is performed in the following manner:

The lighting module 14 is first of all pre-assembled with its components, and is then housed in the slide 48 arranged in the front wall of the insulating support 24. The enclosure 22 is equipped with the control button 66 and the slide 72. The contacts 44*a*, 44*b*; 45*a*, 45*b* are fitted on the two opposite sides of the intermediate support 24 imbricating them between the positioning means 42.

Figure 4:
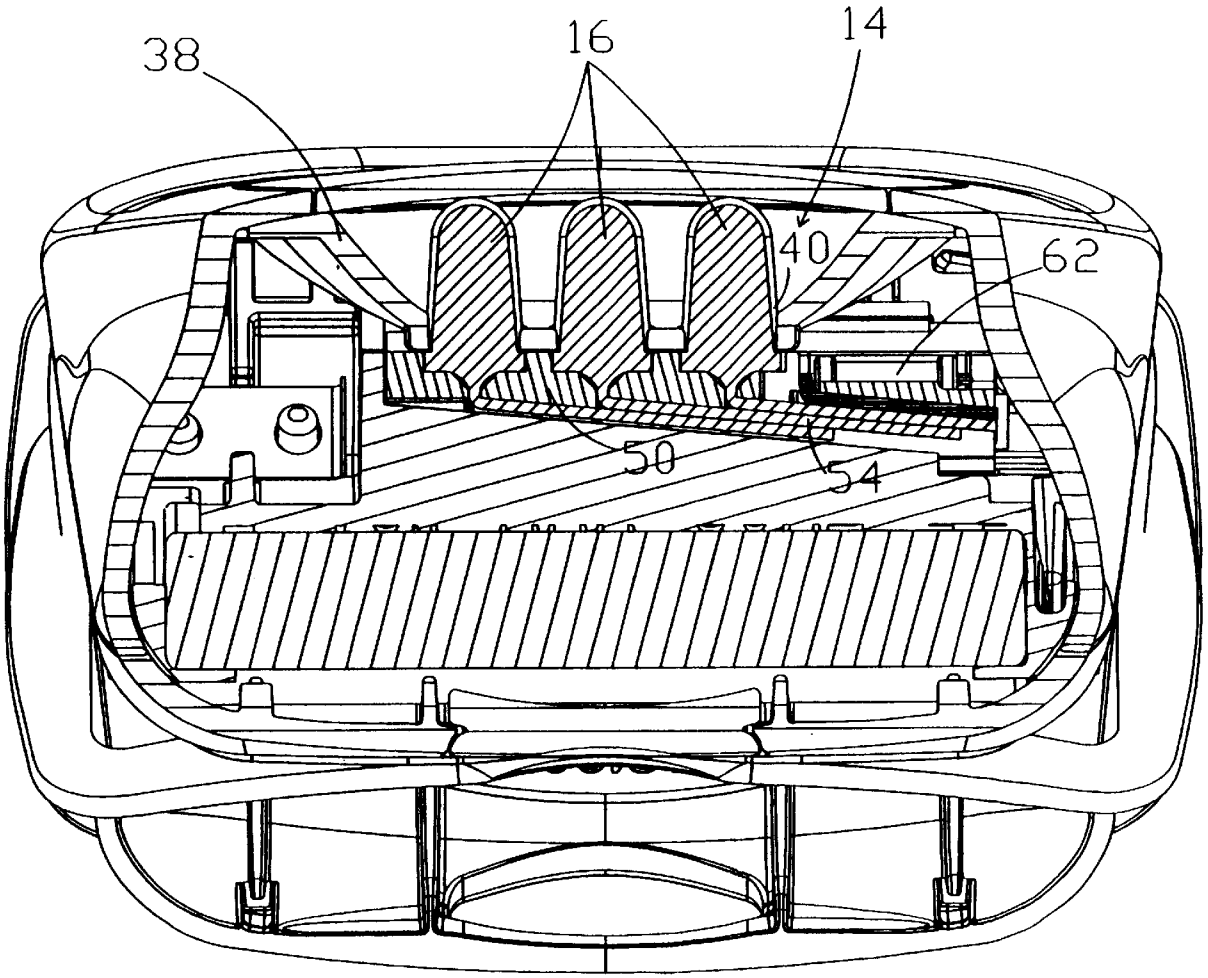
FIG. 4 is a transverse sectional view along the line 4—4 of FIG. 1.
Figure 5:
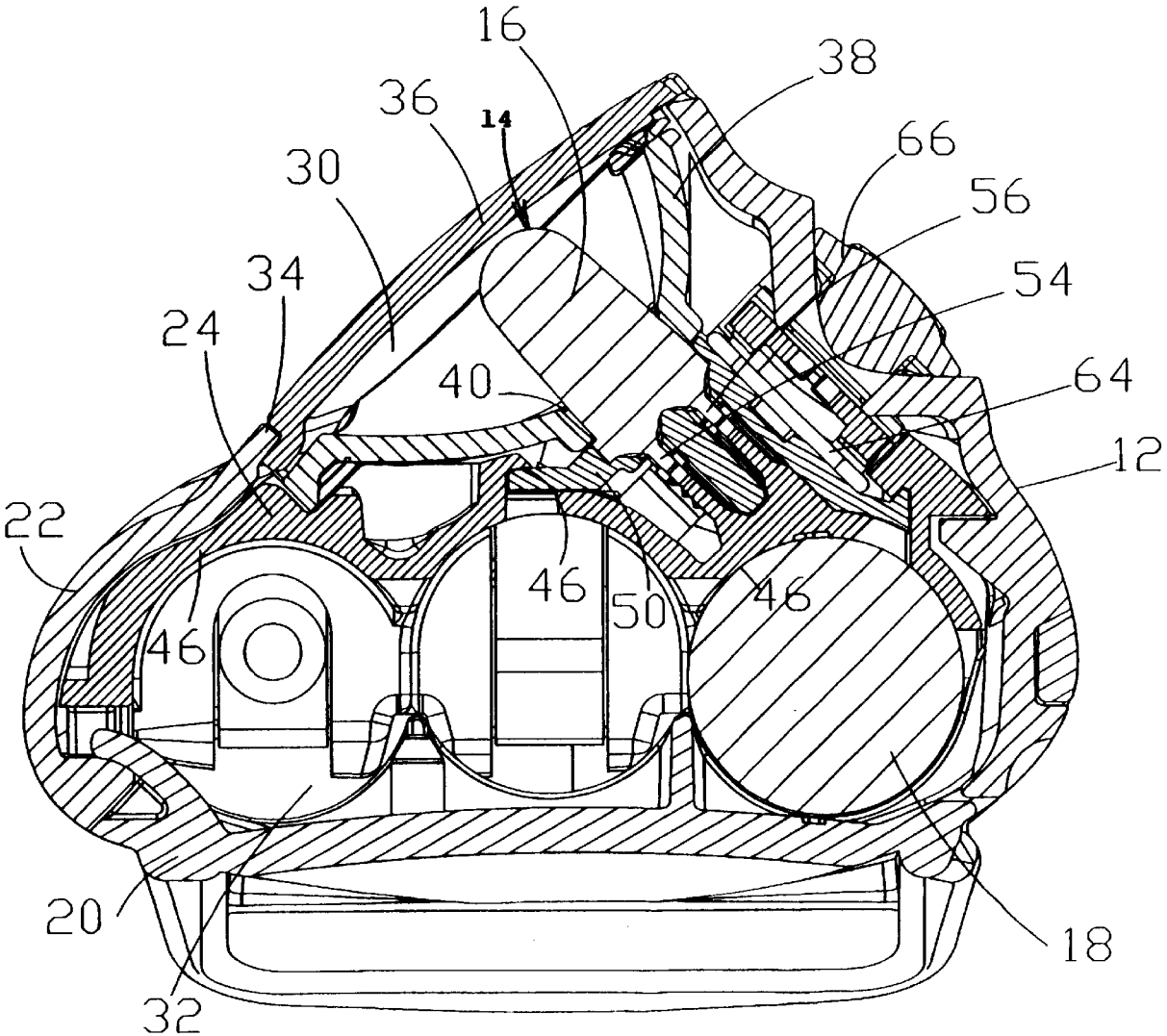
FIG. 5 is a vertical sectional view along the line 5—5 of FIG. 1.
Figure 6:
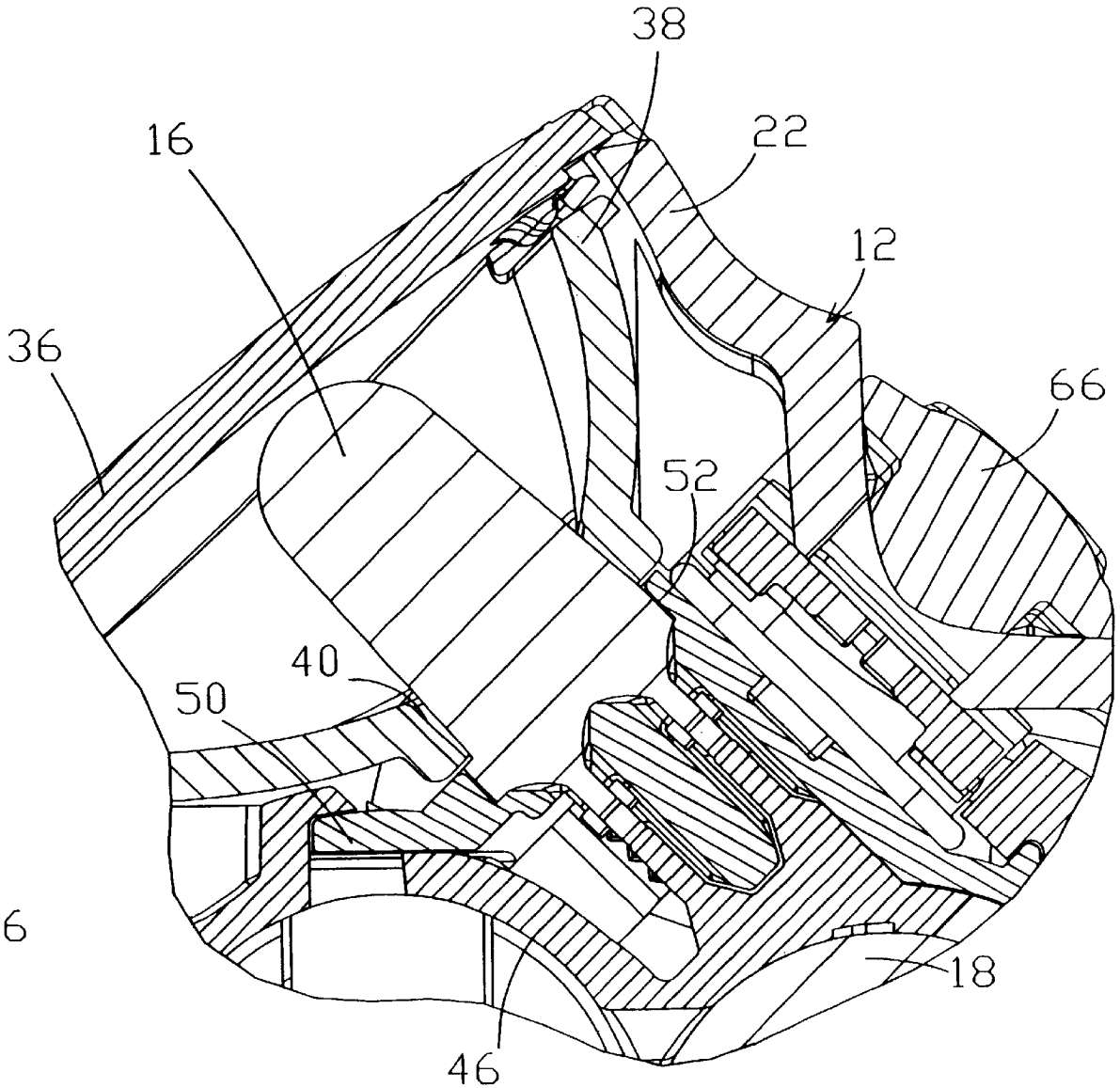
FIG. 6 shows an enlarged scale view of a detail of FIG. 5.
Figure 7:
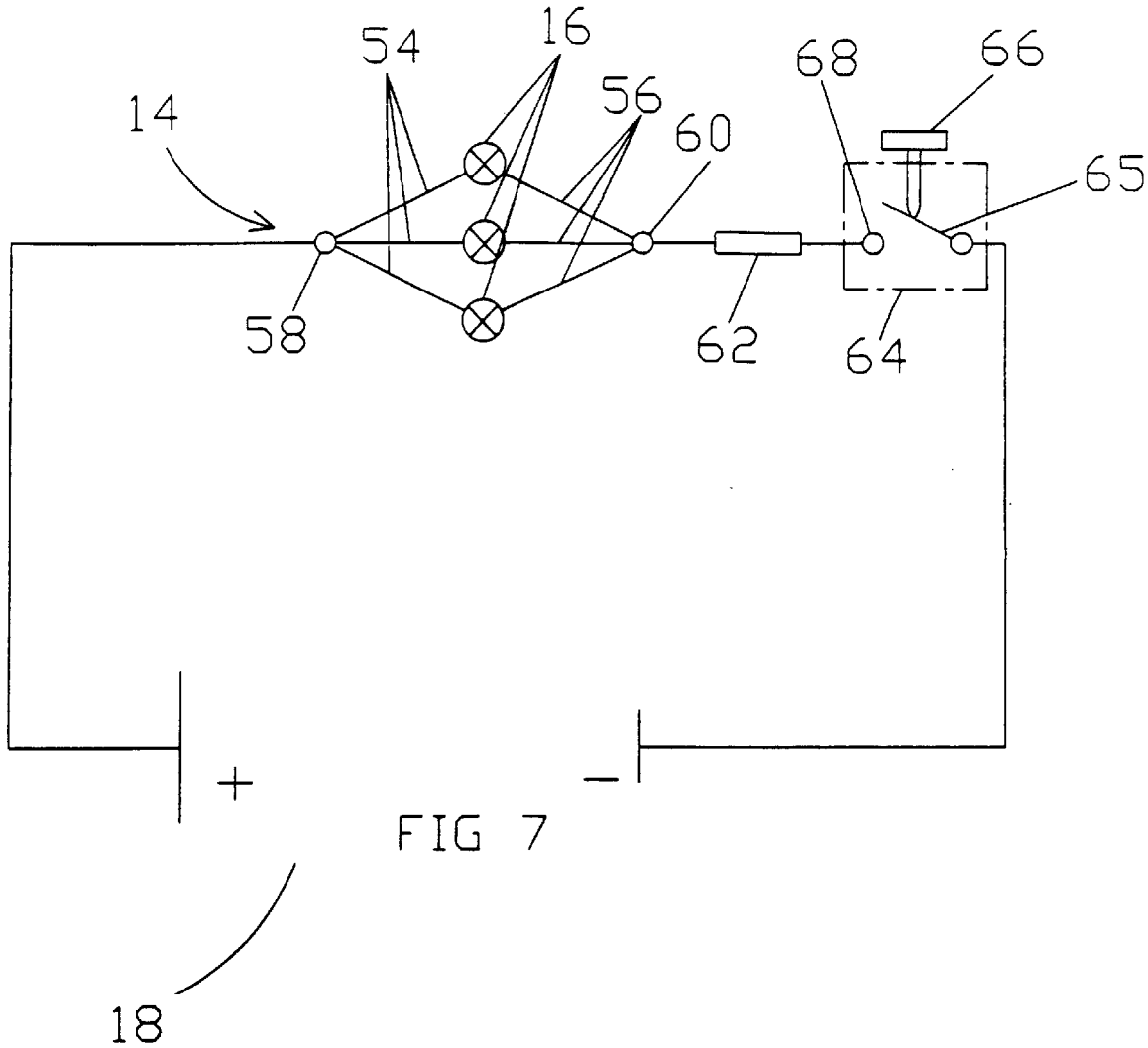
FIG. 7 represents the wiring diagram of the lighting module.
Figure 8:
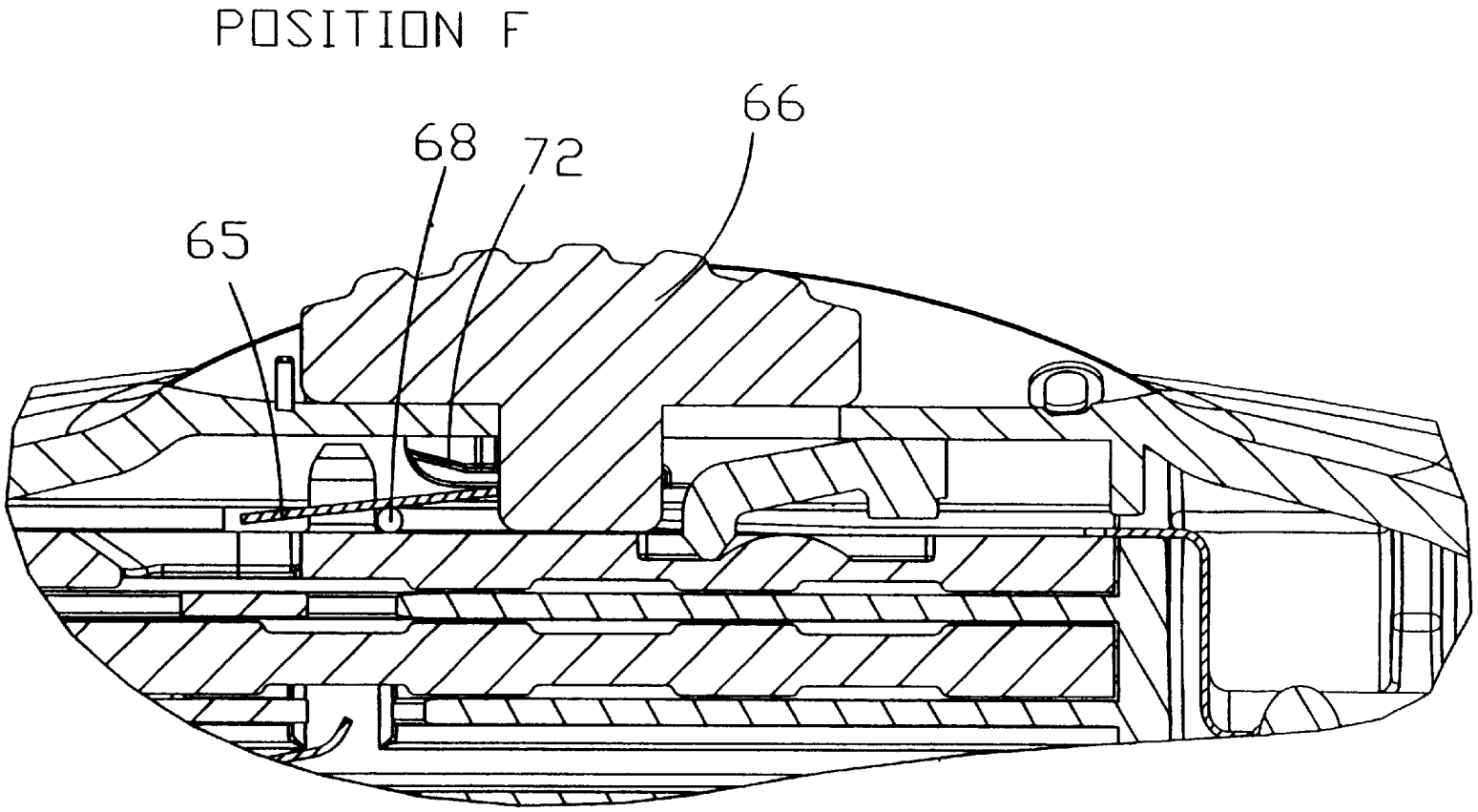
FIGS. 8 and 9 are cross-sectional views of the switch, respectively in the closed position and in the open position.
Figure 9:
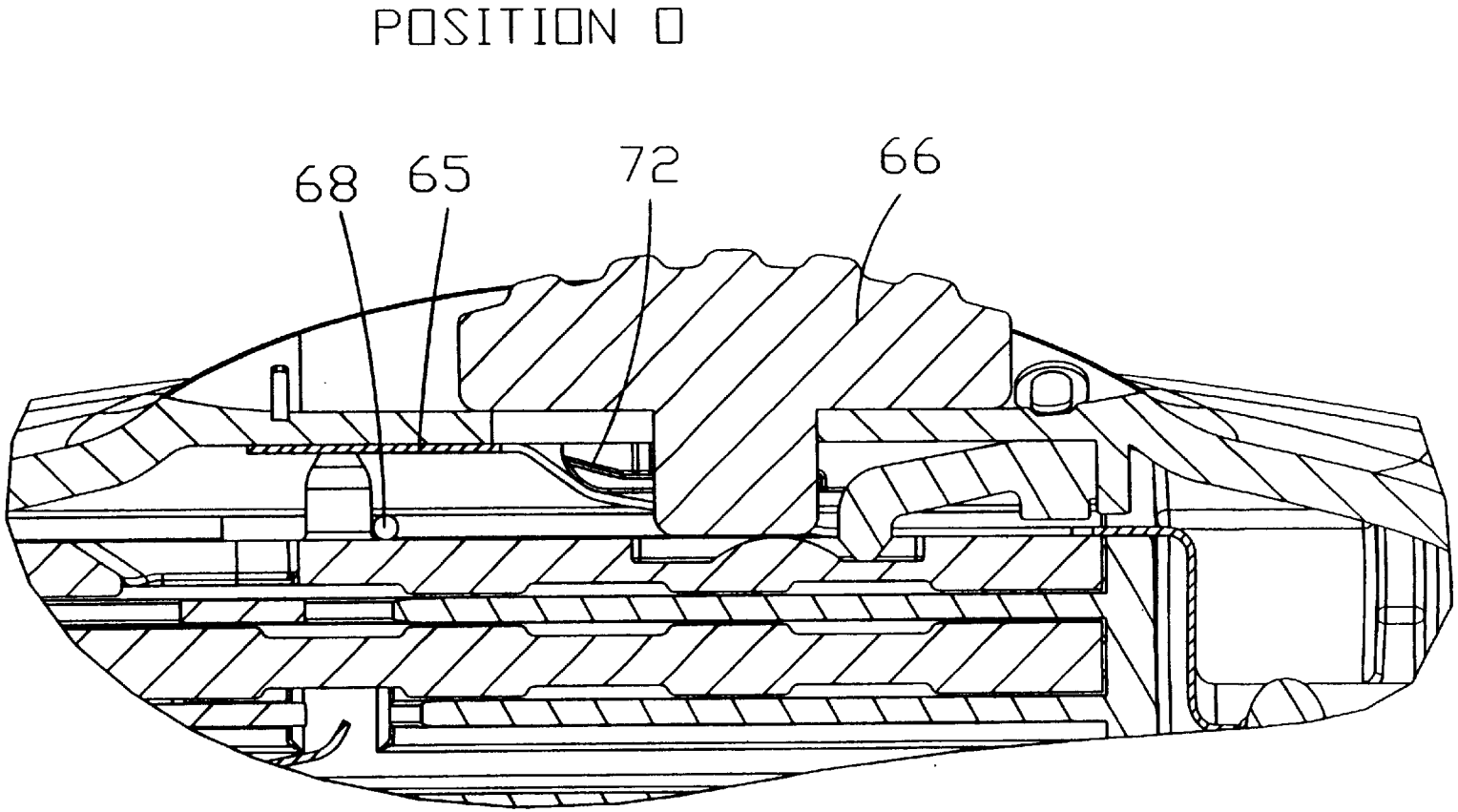

The flexible tabs of the hinges 26, 28 and the reflector 38 are fitted on the sub-assembly of the lighting module 14 and the support 24, followed by insertion in the enclosure 22. The flexible hinges 26, 28 are clipped onto clipping studs 74, 76 of the base 20 (FIG. 2) and the batteries 18 are inserted in the recesses 46 of the support 24. Final fitting of the enclosure 22 and base 20 to one another is performed on the positioning means 42 of the support (FIGS. 1, 4 and 5). The switch 64 becomes operational as soon as the case 12 has been assembled.

What is claimed is:

1. A portable lighting lamp comprising a housing containing a lighting module with light-emitting diodes LED, an electrical power source comprising batteries, rechargeable or not, and a switch to control lighting of the light-emitting diodes LED, and comprising an intermediate support made of insulating plastic material, so as to confine in the housing a first compartment to house the lighting module and a second compartment accommodating the batteries, the intermediate support being equipped with:

positioning means imbricated on two opposite sides between contacts in electrical connection with the light-emitting diodes and the power supply batteries to align and clip the intermediate support onto a dish-shaped base and onto a front enclosure; and recesses on the rear wall for housing the batteries between the contacts.

2. The portable lighting lamp according to claim 1, wherein the lighting module comprises an insulating base-part having a series of recesses for housing the light-emitting diodes, one of the sides of said base-part enabling parallel connection of the wires whereas the other side acts as support for the switch having a flexible contact blade operating in conjunction with a fixed conductor.

3. The portable lighting lamp according to claim 2, wherein the contact blade is actuated by a control button accessible in a groove of the enclosure.

4. The portable lighting lamp according to claim 3, wherein the control button is secured to a mobile slide urging the contact blade to the closed position or the open position of the switch.

5. The portable lighting lamp according to claim 1, wherein a reflector is provided with circular holes for passage of the light-emitting diodes, said reflector being arranged in the first compartment between the lighting module and a glass pane of the front enclosure.

6. The portable lighting lamp according to claim 1, wherein the intermediate support is joined to the base by hinges formed by a pair of flexible plastic tabs clipped onto studs of the base.

7. The portable lighting lamp according to claim 1, wherein the intermediate support has a front wall equipped with a securing means for fitting of the lighting module.

8. The portable lighting lamp according to claim 7, wherein the securing means is formed by a slide or a clip.

* * * * *